US010364608B2

(12) United States Patent
Lines et al.

(10) Patent No.: US 10,364,608 B2
(45) Date of Patent: Jul. 30, 2019

(54) ROTARY STEERABLE SYSTEM HAVING MULTIPLE INDEPENDENT ACTUATORS

(71) Applicant: Weatherford Technology Holdings, LLC, Houston, TX (US)

(72) Inventors: Liam A. Lines, Houston, TX (US); Neil Bird, Houston, TX (US); Daniel A. Marson, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 146 days.

(21) Appl. No.: 15/282,242

(22) Filed: Sep. 30, 2016

(65) Prior Publication Data

US 2018/0094490 A1 Apr. 5, 2018

(51) Int. Cl.
*E21B 47/024* (2006.01)
*E21B 7/06* (2006.01)
(Continued)

(52) U.S. Cl.
CPC ..... *E21B 7/067* (2013.01); *E21B 7/06* (2013.01); *E21B 47/024* (2013.01); *E21B 34/10* (2013.01); *E21B 44/005* (2013.01)

(58) Field of Classification Search
CPC ..... E21B 7/067; E21B 7/06
See application file for complete search history.

(56) References Cited

U.S. PATENT DOCUMENTS 4,416,339 A 11/1983 Baker et al.
5,706,905 A 1/1998 Barr
(Continued)

FOREIGN PATENT DOCUMENTS

EP 1008717 A1 6/2000
GB 2486811 A 6/2012
(Continued)

OTHER PUBLICATIONS

Schlumberger, "PowerDrive X6," Brochure, copyright 2010, 6-pgs.
(Continued)

*Primary Examiner* — David J Bagnell
*Assistant Examiner* — Dany E Akakpo
(74) *Attorney, Agent, or Firm* — Blank Rome LLP

(57) ABSTRACT

A fully rotating bias unit for directional drilling rotates at bit speed while providing proportional control of directional response and steering force. The unit also provides added reliability by having increased redundancy (multiple independently controlled actuators). The unit disposed on a drillstring transfers rotation to a drill bit and has a bore communicating fluid from the drillstring to the drill bit. Directors are disposed on the unit to rotate with it. Each of the directors is independently movable between extended and retracted conditions relative to the unit's housing. Actuators of the unit are in fluid communication between the bore and the borehole or some other low pressure. Each actuator is independently operable to direct communicated fluid from the bore to extend a respective one of the directors toward the extended condition. Meanwhile, venting of the communicated fluid from the directors to the borehole or other low pressure dump allows the respective director to retract toward the retracted condition.

35 Claims, 11 Drawing Sheets

(51) Int. Cl.
*E21B 34/10* (2006.01)
*E21B 44/00* (2006.01)

(56) References Cited

U.S. PATENT DOCUMENTS

| | | | |
|---|---|---|---|
| 6,092,610 | A | 7/2000 | Kosmala et al. |
| 6,109,370 | A | 8/2000 | Gray |
| 6,116,354 | A | 9/2000 | Buytaert |
| 6,158,529 | A | 12/2000 | Dorel |
| 6,290,003 | B1 | 9/2001 | Russell |
| 6,315,062 | B1 | 11/2001 | Alft et al. |
| 6,470,974 | B1 | 10/2002 | Moore et al. |
| 6,837,315 | B2 | 1/2005 | Piosni et al. |
| 6,840,336 | B2 | 1/2005 | Schaaf et al. |
| 6,913,095 | B2 | 7/2005 | Krueger |
| 7,004,263 | B2 | 2/2006 | Moriarity et al. |
| 7,360,610 | B2 | 4/2008 | Hall et al. |
| 7,510,027 | B2 | 3/2009 | Weston et al. |
| 7,510,029 | B2 | 3/2009 | Gunsaulis |
| 7,766,098 | B2 | 8/2010 | Farley |
| 8,255,163 | B2 | 8/2012 | Mauldin et al. |
| 8,528,636 | B2 | 9/2013 | Brooks |
| 8,781,746 | B2 | 7/2014 | Schneider et al. |
| 8,827,006 | B2 | 9/2014 | Moriarty |
| 9,347,279 | B2 | 5/2016 | Crowley et al. |
| 9,366,131 | B2 | 6/2016 | Mauldin et al. |
| 9,567,844 | B2 | 2/2017 | Mauldin et al. |
| 10,100,630 | B2 | 10/2018 | Bartel et al. |
| 2004/0016571 | A1 | 1/2004 | Krueger |
| 2004/0222023 | A1 | 11/2004 | Haci et al. |
| 2006/0243487 | A1 | 11/2006 | Turner et al. |
| 2006/0249287 | A1 | 11/2006 | Downton et al. |
| 2009/0222209 | A1 | 9/2009 | Morys |
| 2009/0260884 | A1 | 10/2009 | Santelmann |
| 2010/0163308 | A1 | 7/2010 | Farley et al. |
| 2011/0066392 | A1 | 3/2011 | Judd |
| 2011/0266063 | A1 | 11/2011 | Downton |
| 2012/0018225 | A1* | 1/2012 | Peter ..... E21B 7/067 175/61 |
| 2012/0160563 | A1* | 6/2012 | Clark ..... E21B 7/06 175/61 |
| 2012/0160564 | A1 | 6/2012 | Downtown et al. |
| 2012/0160565 | A1 | 6/2012 | Downtown et al. |
| 2013/0092439 | A1 | 4/2013 | Mauldin et al. |
| 2014/0014413 | A1 | 1/2014 | Niina et al. |
| 2014/0163888 | A1 | 6/2014 | Bowler et al. |
| 2014/0262507 | A1 | 9/2014 | Marson et al. |
| 2016/0002978 | A1 | 1/2016 | Rushton |
| 2016/0090789 | A1 | 3/2016 | Gajji et al. |
| 2018/0252088 | A1 | 9/2018 | Tilley et al. |

FOREIGN PATENT DOCUMENTS

| | | | |
|---|---|---|---|
| WO | 2012/012624 | A1 | 1/2012 |
| WO | 2014/196958 | A1 | 12/2014 |
| WO | 2015/127345 | A2 | 8/2015 |

OTHER PUBLICATIONS

Weatherford, "Revelotion(R) Rotary-Steerable System," Brochure, copyright 2015, 12-pgs.
Int'l Search Report and Written Opinion in counterpart PCT Appl. PCT/US2017/046856, dated Nov. 20, 2017, 11-pgs.
PCT Search Report and Written Opinion in PCT Appl. No. PCT/US2018/019376; dated May 15, 2018; 12 Pages.
Int'l Search Report and Written Opinion in PCT Appl. PCT/US2017/046883, dated Dec. 5, 2017, 14-pgs.
First office action in copending U.S. Appl. No. 15/452,229, dated Sep. 21, 2018.
First office action in copending U.S. Appl. No. 15/282,379, dated Aug. 6, 2018.
Final office action in copending U.S. Appl. No. 15/282,379, dated Jan. 17, 2019.

* cited by examiner

ROTARY STEERABLE SYSTEM HAVING MULTIPLE INDEPENDENT ACTUATORS

CROSS-REFERENCE TO RELATED APPLICATIONS

This application is filed concurrently with U.S. application Ser. No. 15/282,379 entitled "Control for Rotary Steerable System," which is incorporated herein by reference in its entirety.

FIELD OF THE DISCLOSURE

The subject matter of the present disclosure relates to an apparatus and method for controlling a downhole assembly. The subject matter is likely to find its greatest utility in controlling a steering mechanism of a downhole assembly to steer a drill bit in a chosen direction, and most of the following description will relate to steering applications. It will be understood, however, that the disclosed subject matter may be used to control other parts of a downhole assembly.

BACKGROUND OF THE DISCLOSURE

When drilling for oil and gas, it is desirable to maintain maximum control over the drilling operation, even when the drilling operation may be several kilometers below the surface. Steerable drill bits can be used for directional drilling and are often used when drilling complex borehole trajectories that require accurate control of the path of the drill bit during the drilling operation.

Directional drilling is complicated because the steerable drill bit must operate in harsh borehole conditions. The steering mechanism is typically disposed near the drill bit, and the desired real-time directional control of the steering mechanism is remotely controlled from the surface. Regardless of its depth within the borehole, the steering mechanism must maintain the desired path and direction and must also maintain practical drilling speeds. Finally, the steering mechanism must reliably operate under exceptional heat, pressure, and vibration conditions that will typically be encountered during the drilling operation.

Many types of steering mechanism are used in the industry. A common type of steering mechanism has a motor disposed in a housing with a longitudinal axis that is offset or displaced from the axis of the borehole. The motor can be of a variety of types including electric and hydraulic. Hydraulic motors that operate using the circulating drilling fluid are commonly known as a "mud" motors.

The laterally offset motor housing, commonly referred to as a bent housing or "bent sub", provides lateral displacement that can be used to change the trajectory of the borehole. By rotating the drill bit with the motor and simultaneously rotating the motor housing with the drillstring, the orientation of the housing offset continuously changes, and the path of the advancing borehole is maintained substantially parallel to the axis of the drillstring. By only rotating the drill bit with the motor without rotating the drillstring, the path of the borehole is deviated from the axis of the non-rotating drillstring in the direction of the offset on the bent housing.

Another steering mechanism is a rotary steerable tool that allows the drill bit to be moved in any chosen direction. In this way, the direction (and degree) of curvature of the borehole can be determined during the drilling operation, and can be chosen based on the measured drilling conditions at a particular borehole depth.

Although various steering mechanisms are effective, operators are continually looking for faster, more powerful, reliable, and cost effective directional drilling mechanisms and techniques. The subject matter of the present disclosure is directed to such an endeavor.

SUMMARY OF THE DISCLOSURE

According to the present disclosure, a drilling assembly disposed on a drillstring deviates a borehole (i.e., changes the trajectory of the borehole) advanced by a drill bit. The assembly includes a housing, directors, and actuators. The housing disposed on the drillstring transfers rotation to the drill bit and has a bore communicating fluid from the drillstring to the drill bit. In general, the housing can have the rotation imparted to it by the drillstring, by a motor disposed on the drillstring, or by both the drillstring and the motor.

The directors are disposed on the housing to rotate therewith. Each of the directors is independently movable between an extended condition and a retracted condition relative to the housing. The actuators are disposed on the housing in fluid communication between the bore and the borehole. Each of the actuators is independently operable between first and second conditions. In the first condition, each actuator directs communicated fluid from the bore to extend a respective one of the one or more directors toward the extended condition. Conversely, each actuator in the second condition permits the respective director to retract toward the retracted condition.

The communicated fluid of the directors is vented to a lower pressure to permit retraction of the directors. In general, this lower pressure can be the borehole annulus, downstream of a choke in the bore of the assembly, or downstream of a restriction internal to the assembly. The venting of the communicated fluid from the directors can be actively performed by the actuators, or the venting can occur passively and continuously from the directors.

The first and second conditions can correspond to opened and closed positions of the actuators or components thereof. The actuators may also be capable of fully proportional control at multiple conditions. The actuators can actively vent the communicated fluid to the low pressure (e.g., borehole annulus) based on the actuator position, or the assembly may be constantly venting the communicated fluid irrespective of the actuator position.

In a first example, each actuator may include a valve operable between opened and closed positions. Operating the valve in these positions, the actuator can communicate (or not communicate) flow to a module for a respective deflector. Communication of the flow can extend the deflector, whereas no communication may allow the deflector to retract. The module may continuously communicate or vent the flow to borehole annulus, or the valve may have an outlet that actively vents to the borehole annulus when in the valve has the closed position.

In a second example, each actuator may include a valve operable between opened and closed (or mostly closed) positions and proportional conditions in between. Using the proportional valve, the actuator can communicate proportional flow to a module for a respective deflector. The proportional communication of the flow can extend the deflector with a proportional force, whereas reduced communication below a level may allow the deflector to retract. The module may continuously communicate or vent the flow to borehole annulus.

The valve in the first example can be a pilot-operated linear spool valve that is 3-way and has 2-positions (i.e., opened and closed) or can be a rotary valve having 2-postions. Alternatively, the valve in the second example can be a rotary valve capable of providing full control of the orientation used for the directors. These rotary valves can vary an inlet orifice size of flow to the respective director and therefore can provide some control over the force output of the director.

To deviate the advancing borehole, the assembly changes the trajectory of the drilling assembly as the transverse displacements of the directors displace the longitudinal axis of the housing relative to the advancing borehole. The system uses synchronous actuation of the individual directors as they rotate with the housing as it imparts rotation to the drill bit.

According to the present disclosure, a drilling method involves advancing a borehole with a drill bit on a drilling assembly coupled to a drillstring by transferring rotation of the drilling assembly to the drill bit. Actuators disposed to rotate with the drilling assembly are independently operated. Flow through the drilling assembly and the borehole is controlled using the independently operated actuators, and directors disposed to rotate with the drilling assembly are independently moved using the controlled flow. Ultimately, the advancing borehole is deviated with the drilling assembly using the independently moved directors.

In other words, the actuators control flow between the bore and the low pressure (e.g. annulus), not necessarily thorough the drilling assembly. The flow measured immediately above the inlet/outlet to the actuators would remain constant. The flow below the actuator inlet ports is being changed slightly.

To control the fluid flow through the drilling assembly, a steering direction can be determined for the drilling assembly, and an angular orientation of the drilling assembly can be sensed. The fluid flow through the drilling assembly can then be varied by one or more of the actuators to one or more of the respective directors based upon the determined steering direction and the sensed angular orientation.

In one benefit, the disclosed system can provide independent and proportional control over directional response. Independent control of the directors allows for the system to do some unique things, and various strategies to achieve proportionality are possible. For example, the system having three directors can use one push, two pushes, or three pushes per rotation. In another arrangement, the system can change the open arc angle over which the directors are extended or can change the target direction over the course of one rotation so that the resultant force vector in the target direction is reduced.

Moreover, the disclosed system can have all directors retracted OR all extended at the same time. Retraction of all directors can be used in advancing the borehole along a straight trajectory at least for a time. Extension of all of the directors can provide reaming or stabilizing benefits during drilling.

The independent actuators also afford some redundancy. In this way, the apparatus can operate along although one or even two of the actuators have failed while still maintaining some directional control. An integral fail safe mechanism can be used to ensure the valves of the directors fail in a closed position, or the control system can receive feedback to detect the telltale signs of failure and preemptively park the actuator in the closed position. For instance, the control system can detect deteriorating actuator health and can pre-emptively shut down a given actuator/deflector so that it does not hinder the performance of the remaining actuators or unduly inhibit directional control. Additionally, a fail-safe feature can use a physical mechanism (e.g., magnetic detent) or the like that causes the flow path to the deflector to be closed when the actuator fails so the deflector fails retracted.

The disclosed system may be directed to a push-the-bit configuration of steering. In push-the-bit, the drilling direction of the bit in a desired direction is achieved by pushing the deflectors against the side of the borehole in an opposing direction. Comparable components and techniques disclosed herein can be use in the other type of steering configuration of point-the-bit. In such a point-the-bit configuration, the drilling direction of the bit in a desired direction is achieved by pushing an internal drive shaft of the system having the drill bit in the desired direction. This is not the only option because a driveshaft is not necessarily required. As an alternative, the disclosed system for point-the-bit may instead include a fulcrum point between the deflectors and the drill bit so that pushing the deflectors against the side of the wellbore in the same direction as the intended bit direction can push the bit for direction drilling. As such, the components and techniques disclosed herein with respect to the push-the-bit system can apply equally well to a point-the-bit system because it would merely involve a reversal of pushing components from external (push) to internal (point) and a reversal of the directing of pushing from external to internal.

The foregoing summary is not intended to summarize each potential embodiment or every aspect of the present disclosure.

DETAILED DESCRIPTION OF THE DISCLOSURE

Figure 1A:
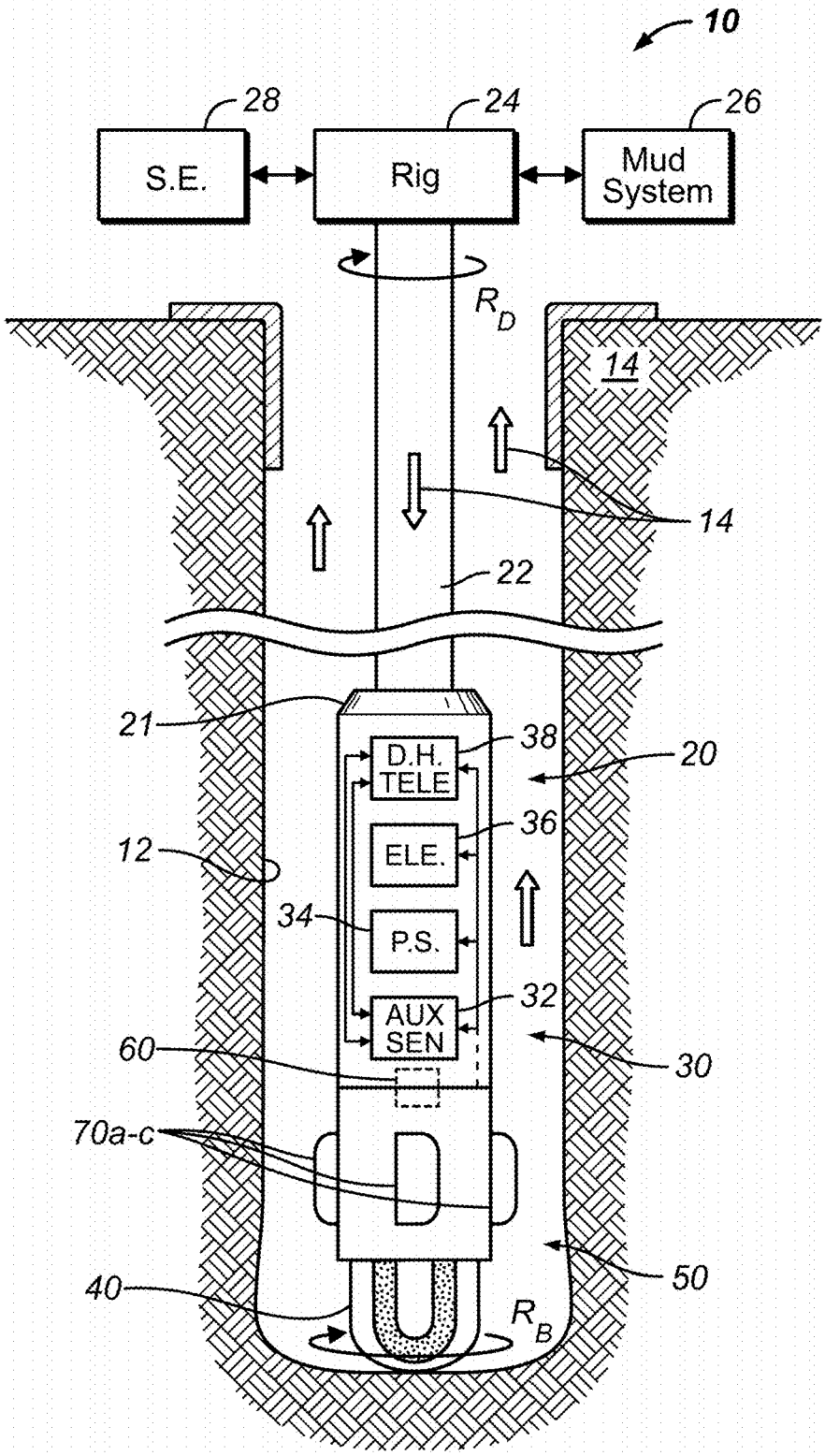
FIGS. 1A-1C schematically illustrate a downhole assembly incorporating a steering apparatus according to the present disclosure.

FIG. 1A schematically illustrates a drilling system 10 incorporating a rotating steering apparatus 50 according to the present disclosure. As shown, a downhole drilling assembly 20 drills a borehole 12 penetrating an earth formation. The assembly 20 is operationally connected to a drillstring 22 using a suitable connector 21. In turn, the drillstring 22 is operationally connected to a rotary drilling rig 24 or other known type of surface drive.

The downhole assembly 20 includes a control assembly 30 having a sensor section 32, a power supply section 34, an electronics section 36, and a downhole telemetry section 38. The sensor section 32 has directional sensors, such as accelerometers, magnetometers, and inclinometers, which can be used to indicate the orientation, movement, and other parameters of the downhole assembly 20 within the borehole 12. This information, in turn, can be used to define the borehole's trajectory for steering purposes. The sensor section 32 can also have any other type of sensors used in Measurement-While-Drilling (MWD) and Logging-While-Drilling (LWD) operations including, but not limited to, sensors responsive to gamma radiation, neutron radiation, and electromagnetic fields, such as available on Weatherford's HEL system.

The electronics section 36 has electronic circuitry to operate and control other elements within the downhole assembly 20. For example, the electronics section 46 has downhole processor(s) (not shown) and downhole memory (not shown). The memory can store directional drilling parameters, measurements made with the sensor section 32, and directional drilling operating systems. The downhole processor(s) can process the measurement data and telemetry data for the various purposes disclosed herein.

Elements within the downhole assembly 20 communicate with surface equipment 28 using the downhole telemetry section 28. Components of this telemetry section 38 receive and transmit data to an uphole telemetry unit (not shown) within the surface equipment 38. Various types of borehole telemetry systems can be used, including mud pulse systems, mud siren systems, electromagnetic systems, angular velocity encoding, and acoustic systems.

The power supply section 34 supplies electrical power necessary to operate the other elements within the assembly 20. The power is typically supplied by batteries, but the batteries can be supplemented by power extracted from the drilling fluid by way of a power turbine, for example.

During operation, a drill bit 40 is rotated, as conceptually illustrated by the arrow $R_B$. The rotation of the drill bit 40 is imparted by rotation $R_D$ of the drillstring 22 at the rotary rig 24. The speed (RPM) of the drillstring rotation $R_D$ is typically controlled from the surface using the surface equipment 28. Additional rotation to the drill bit 40 can also be imparted by a drilling motor (not shown) on the drilling assembly 20.

During operation, the drilling fluid system 26 pumps drilling fluid or "mud" from the surface downward and through the drillstring 22 to the downhole assembly 20. The mud exits through the drill bit 40 and returns to the surface via the borehole annulus. Circulation is illustrated conceptually by the arrows 14.

To directionally drill the advancing borehole 12 with the downhole assembly 20, a controller 60 is operated to change delivery of a portion of the flow of the fluid (circulated drilling mud) to the rotating steering apparatus 50 having multiple directional devices or directors 70*a-c*. The apparatus 50 rotates with the drill string 22 and/or with a drilling motor (not shown) in rotating of the drill bit 40. For instance, the apparatus 50 may rotate at the same rate as the drillstring 22. Of course, the apparatus 50 can be used with a downhole drilling motor (not shown) disposed uphole of the apparatus 50. In this situation, the apparatus 50 can rotate at the output speed of the motor if the drillstring is not rotating, at the output speed of the drillstring 22 if the motor is clutched or not present, or at the combined output of the drillstring 22 and motor if both are rotating. Accordingly, the apparatus 50 can generally be said to always rotate at drill bit speed.

Changing delivery of the fluid is made to each of the multiple directors 70*a-c* independently and is controlled to alter the direction of the steering apparatus 50 as it advances the borehole 12. The controller 60 is controlled using orientation information measured by the sensor section 32 cooperating with control information stored in the downhole memory of the electronics section 36 to direct the trajectory of the advancing borehole 12.

By independently operating the multiple directors 70*a-c*, the steering apparatus 50 steers the advancing borehole using active deflection as the apparatus 50 rotates with the drill string 22. Because the entire apparatus 50 rotates, there is essentially no non-rotating platform in the apparatus 50 to actuate the directors 70*a-c*. During operation, for example, the controller 60 controls the flow of fluid through the downhole assembly 20 and delivers portions of the fluid independently to the multiple directional devices 70*a-c* of the steering apparatus 50. In turn, the directional devices 70*a-c* then use the pressure applied from the delivered flow to periodically extend/retract relative to the drill bit's rotation $R_B$ to define the trajectory of the advancing borehole 12.

The independent extension/retraction of the directional devices 70*a-c* can be coordinated with the orientation of the drilling assembly 20 in the advancing borehole 12 to control the trajectory of drilling, drill straight ahead, and enable proportional dogleg control. In the end, the extension/retraction of the directional devices 70*a-c* disproportionately engages the drill bit 40 against a certain side in the advancing borehole 12 for directional drilling. (Reference to disproportionate engagement at least means that the engagement in advancing the borehole 14 is periodic, varied, repetitive, selective, modulated, changing over time, etc.)

Moreover, the resultant rotational speed $R_B$ of the drill bit 40 can be periodically varied by periodically varying the rotational speed of a mud motor (not shown) and/or by periodically varying the rotational speed $R_D$ of the drillstring 22. Such periodic bit speed rotation RB (referred to herein as a "bit speed effect") results in preferential cutting of material from a predetermined arc of the borehole's wall, which in turn results in deviation of the borehole 10. This targeted bit speed may be more beneficial to the embodiment of the disclosed apparatus 50 having directors 70 that are not equally spaced around its circumference. Further details of the bit speed effect are disclosed in incorporated U.S. Pat. No. 7,766,098.

Figure 1B:
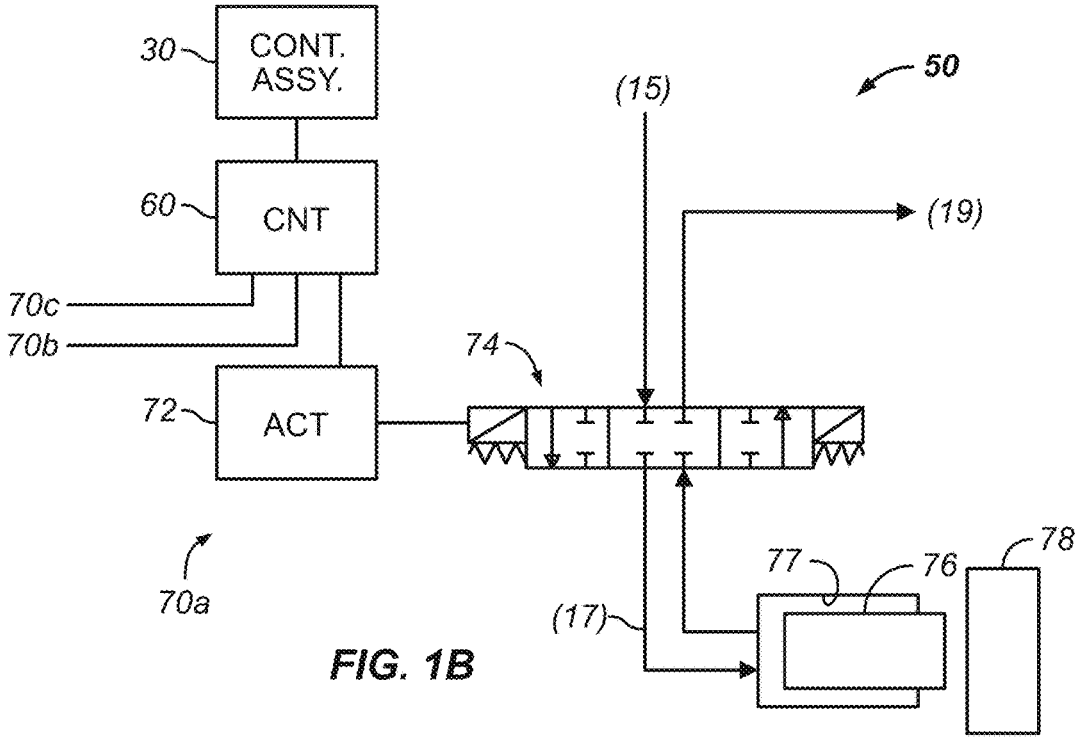
Figure 1C:
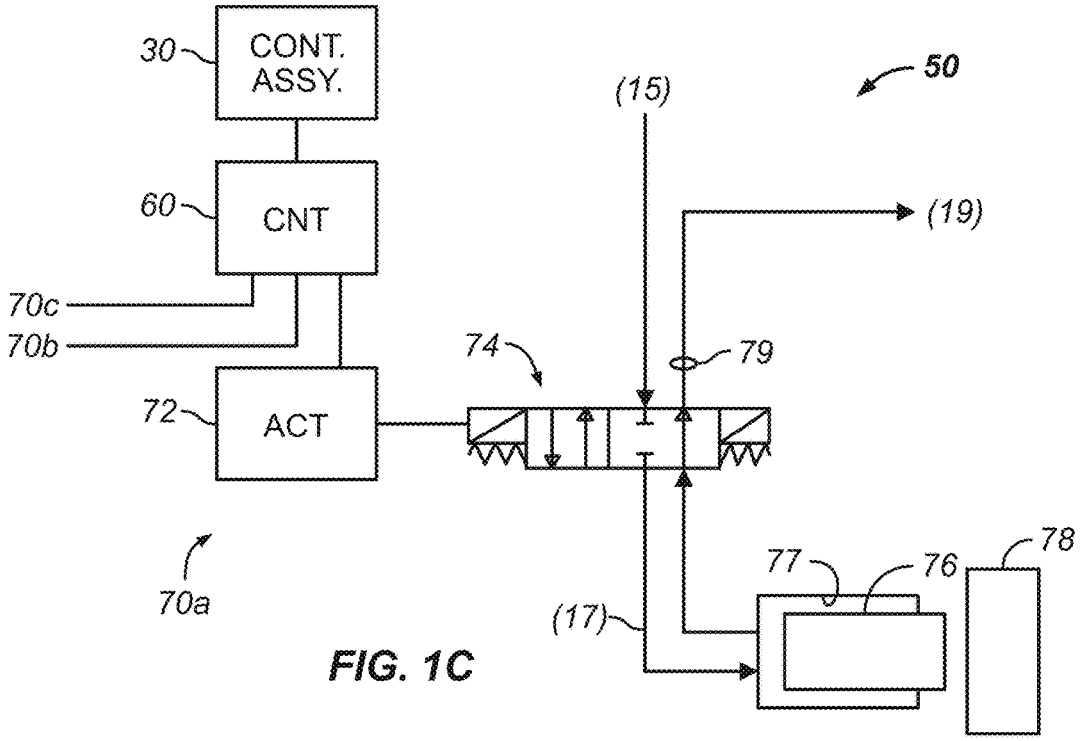

Features of the steering apparatus 50 are shown in more detail in FIGS. 1B-1C. The controller 60 connects to the sensors and power source of the control assembly 30 and connects to each of the directional devices or directors 70*a-c*—only one of which is schematically shown here. Each directional device 70*a-c* includes an actuator 72, a valve 74, a piston 76, a piston chamber 77, and a pad 78 disposed on the apparatus 50 to rotate therewith. Each device 70*a-c* is independently operable to move its pad 78 between an extended condition and a retracted condition relative to the apparatus 50.

The steering apparatus 50 of FIGS. 1A-1C operates to steer drilling during continuous rotation, which can be up to 300-rpm with peaks much higher of about 600-rpm. Each actuator 72 can be operated to extend its pad 78 at the same target position, synchronous to the drill string's rotation. Meanwhile, the rotary position of the controller 60 is determined by the sensors of the control system 30 (discussed in more detail later).

As shown, each piston 76 has a dedicated actuator 72, and drilling fluid is used to energize the piston 76 and its pad 78. To do this, the controller 60 operates the device's actuator 72 to actuate the valve 74 and control fluid communication of tool flow 15 to either piston flow 17 (for the piston 76) or vent flow 19 (for the borehole). For example, the valve 74 in a first condition directs communicated tool flow 15 to the piston 76 to extend the pad 78 toward the extended condition. By contrast, the valve 74 in a second condition vents the communicated piston flow 17 to the borehole to retract the pad 78 toward the retracted condition.

Although depicted in FIGS. 1B-1C with one actuator 72 and valve 74, the system may instead use dual actuators 72 and valves 74 for each piston 76 to achieve respective active energizing and venting. In this case, the dual actuators 72 and valves 74 can be tuned with different responses relative to one another for control.

Although depicted in FIG. 1B with a valve setting for actively venting the chamber 77 to vent flow 19, the system may instead be always actively or passively venting the piston chamber 77 to vent flow 19 for the borehole. A brief example of this is shown in FIG. 1C. In this case, the valve 74 may have more simplified settings, and the vent flow 19 may even passively lead from the piston chamber 77. Moreover, the vent flow 19 leading from the piston chamber 77 to the borehole can be configured or tuned with a choke or a restricted orifice 79 to define a particular flow restriction for the venting.

Spring returns (not shown in FIGS. 1B-1C) or the like can be used for the pistons 76, pads 78, or director 70 in general and may be provided to retract the pistons 76 when not energized with piston flow 17. In fact, such spring returns may be necessary is some implementations. The valve 74 can be a linear or rotary type of valve. The linear type valve can have controlled venting of the communicated fluid and can rapidly move a 3-way, 2-position valve element to supply and vent drilling fluid to and from the actuator's piston 76. The rotary type valve may have passive venting of the communicated fluid. This rotary valve may be 2 way, but may stop at any point throughout one rotation to provide a proportionate amount of flow.

Given the above description of the drilling system 10, discussion now turns to embodiments of the drilling assembly 20 having the steering apparatus 50 to achieve directional drilling.

Figure 2A:
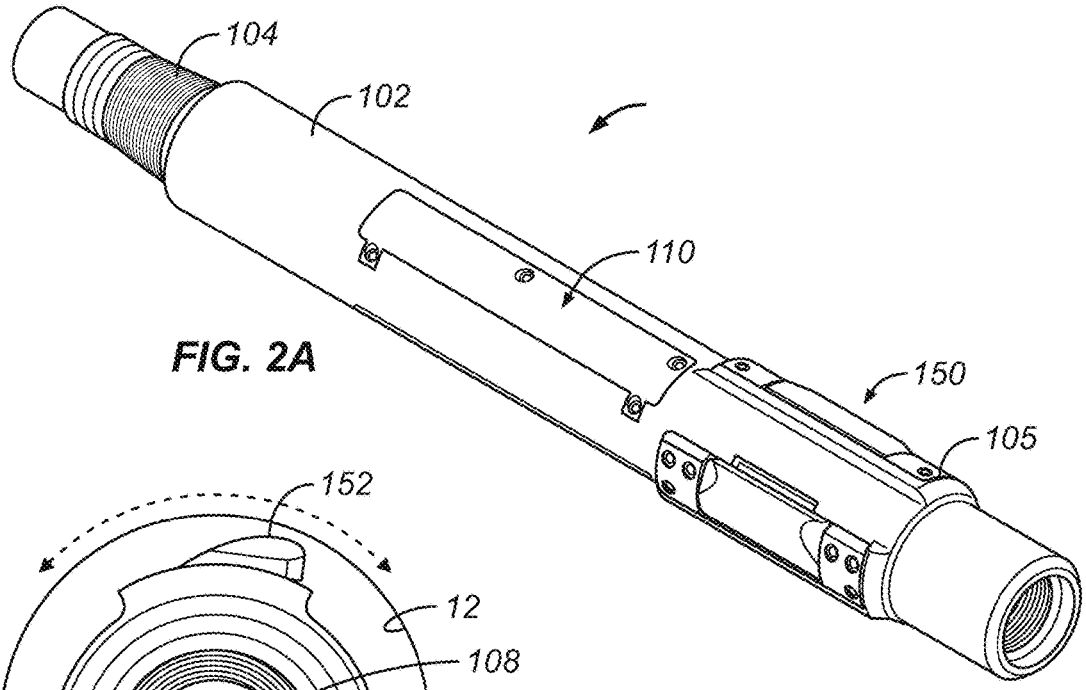
FIGS. 2A-2D illustrate an embodiment of the steering apparatus in perspective, end, and cross-sectional views.

FIG. 2A illustrates a perspective view of portion of a steering apparatus 50 for the drilling assembly (20) according to the present disclosure. As already noted, the steering apparatus 50 of the drilling assembly (20) is disposed on a drillstring (22) for deviating a borehole advanced by the drill bit (40). Further details of the steering apparatus 50 are provided in the end-view of FIG. 2B and the end-sectional view of FIG. 2C The apparatus 50 has a housing or drill collar 102 that couples at an uphole end 104 (with pin thread) to uphole components of the assembly (20) and that couples at a downhole end 106 (with box thread) to downhole components of the assembly (20). Multiple directional devices or directors 150 are disposed on the housing 102 near the end (106) for connection toward the drill bit (40), and each of the directors 150 is associated with an actuator device 110 also disposed on the housing 102. The directors 150 can be arranged on multiple sides of the housing 102 (either symmetrically or asymmetrically), and they can be disposed at stabilizer ribs or other features 105 on the housing 102.

Figure 2B:
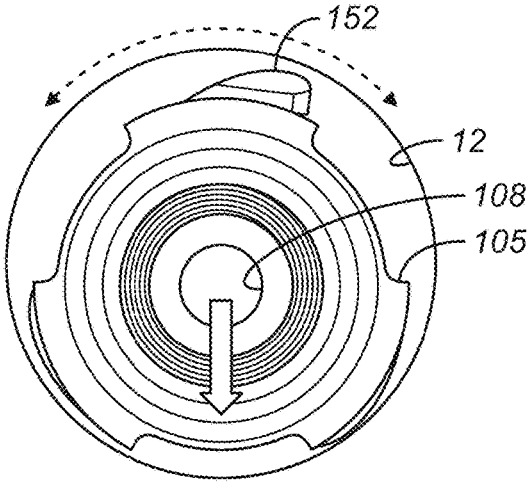
Figure 2C:
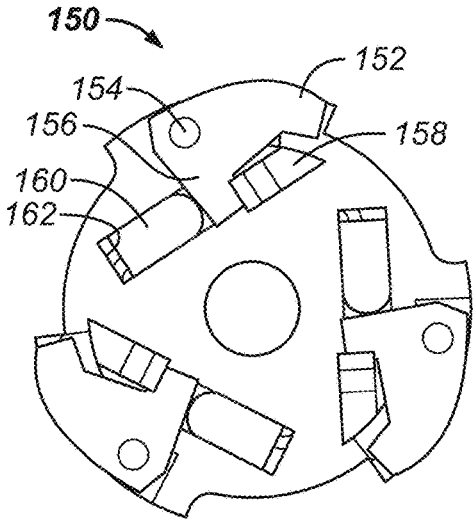

As shown here in FIGS. 2A-2C, the steering apparatus 50 includes three directors 150*a-c* arranged at about every 120-degrees. In general, more or less devices 150 can be used. Preferably, the arrangement is symmetrical or uniform, which simplifies control and operation of the apparatus 50, but this is not strictly necessary.

Each of the directors 150 includes a pad 152 that rotates on a pivot point 154. For each director 150, a piston 160 engages one side of a lever 156 of the pad 152, while a biasing element 158 engages the opposite side of the lever 156. The biasing element 158 biases against the other side of the lever to counter the movement of the piston 160. In this way, the piston 160 is alternatingly displaceable in the housing chamber 162 between extended and retracted conditions to pivot the pad 152 to extend away from the housing 102 or retract in toward the housing 102. As noted herein, other arrangements are possible. For example, the piston 160 can contact the underside of the pad 152 directly. The pistons 160 can stroke in a radial direction as opposed to stroking in a tangential direction, and there may be no biasing element to retract the pads 152. Instead, the pads 152 may retract naturally under the rotation of the housing 102 in the wellbore.

The housing 102 has an axial bore 108 along the housing's longitudinal axis (L) communicating the drillstring (22) with the drill bit (40). Internal flow components can direct at least a portion of the tool flow from the bore 108 independently to each of the piston chambers 162 for the pistons 160 and can vent the fluid in the piston chambers 162 independently to outside the apparatus 50 (i.e., to the borehole annulus).

The pads 152 can have surface treatment, such as Tungsten Carbide hard facing, or other feature to resist wear. The housing 102 can be configured for more than one borehole size. For example, the housing 102 can be used for drilling 8-⅜, 8-½, and 8-¾ in. hole sizes. However, different pads 152 of different lengths and dimensions can be used with a given the housing 102 for the different hole sizes. This gives some versatility and modularity to the assembly.

Figure 2D:
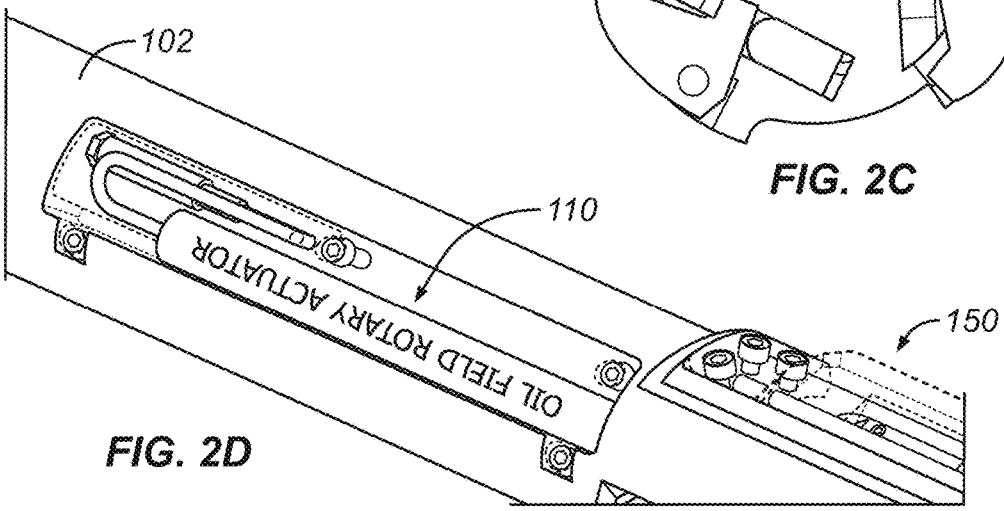

As shown in FIG. 2D, the housing 102 has an oil filled rotary actuating device 10 that is housed in a pocket of the housing 102 and connects independently to its respective director 150.

Figure 3A:
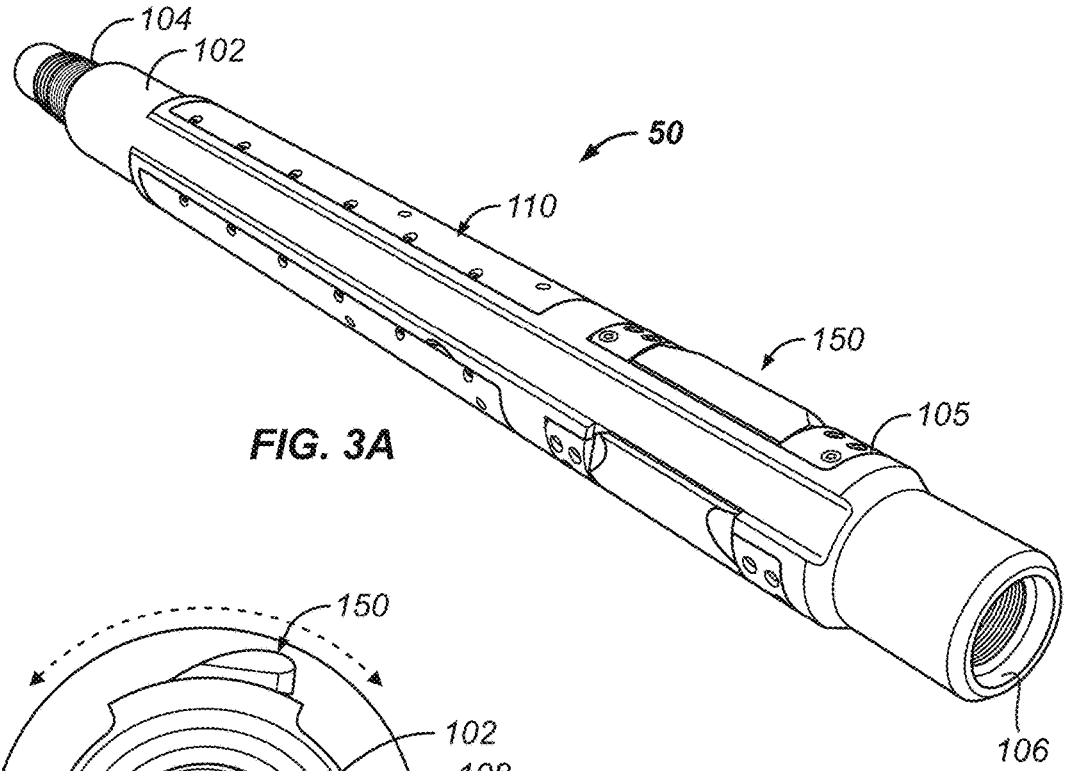
FIGS. 3A-3C illustrate another embodiment of the steering apparatus in perspective, end, and cross-sectional views.
Figure 3B:
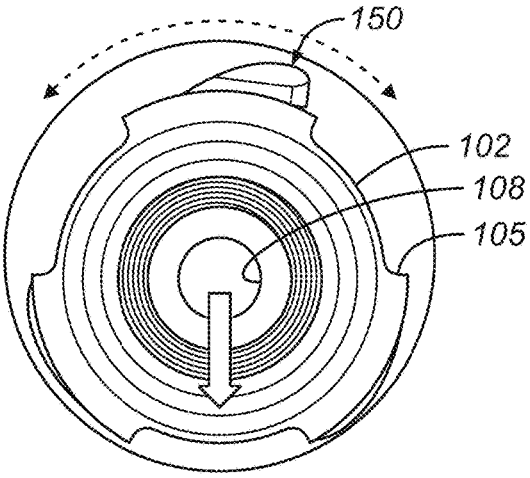
Figure 3C:
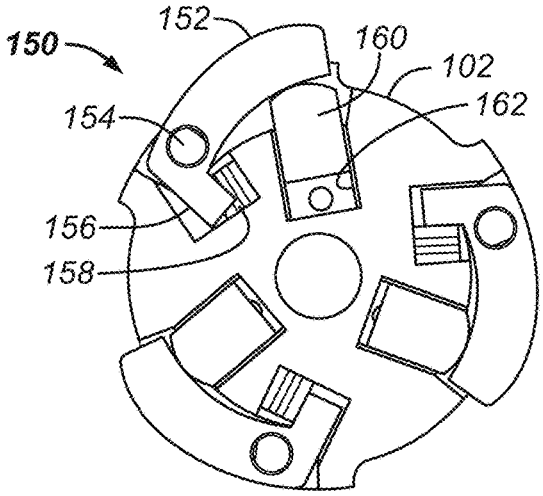

FIGS. 3A-3C illustrate an alternative configuration for the steering apparatus 50. As before, FIG. 3A illustrates a perspective view of portion of the steering apparatus 50 for the drilling assembly (20). As already noted, the steering apparatus 50 of the drilling assembly (20) is disposed on a drillstring (22) for deviating a borehole advanced by the drill bit (40). Further details of the steering apparatus 50 are provided in the end-view of FIG. 3B and the end-sectional view of FIG. 3C.

In this arrangement, each of the directors 150 includes a pad 152 that rotates on a pivot point 154. For each director 150, a piston 160 engages the under-side of the pad 152, while a biasing element 158 engages an inner side of a lever 156 on the pad 152.

As will be appreciated with the configurations in FIGS. 2C and 3C show, different arrangements of pads, pistons, and biasing elements can be used to extend and retract relative to the apparatus' housing. In fact, pistons alone can be used on the apparatus 50 to extend and retract for engaging or disengaging a borehole without the use of pivoting pads 152, as explicitly shown here.

Figure 4A:
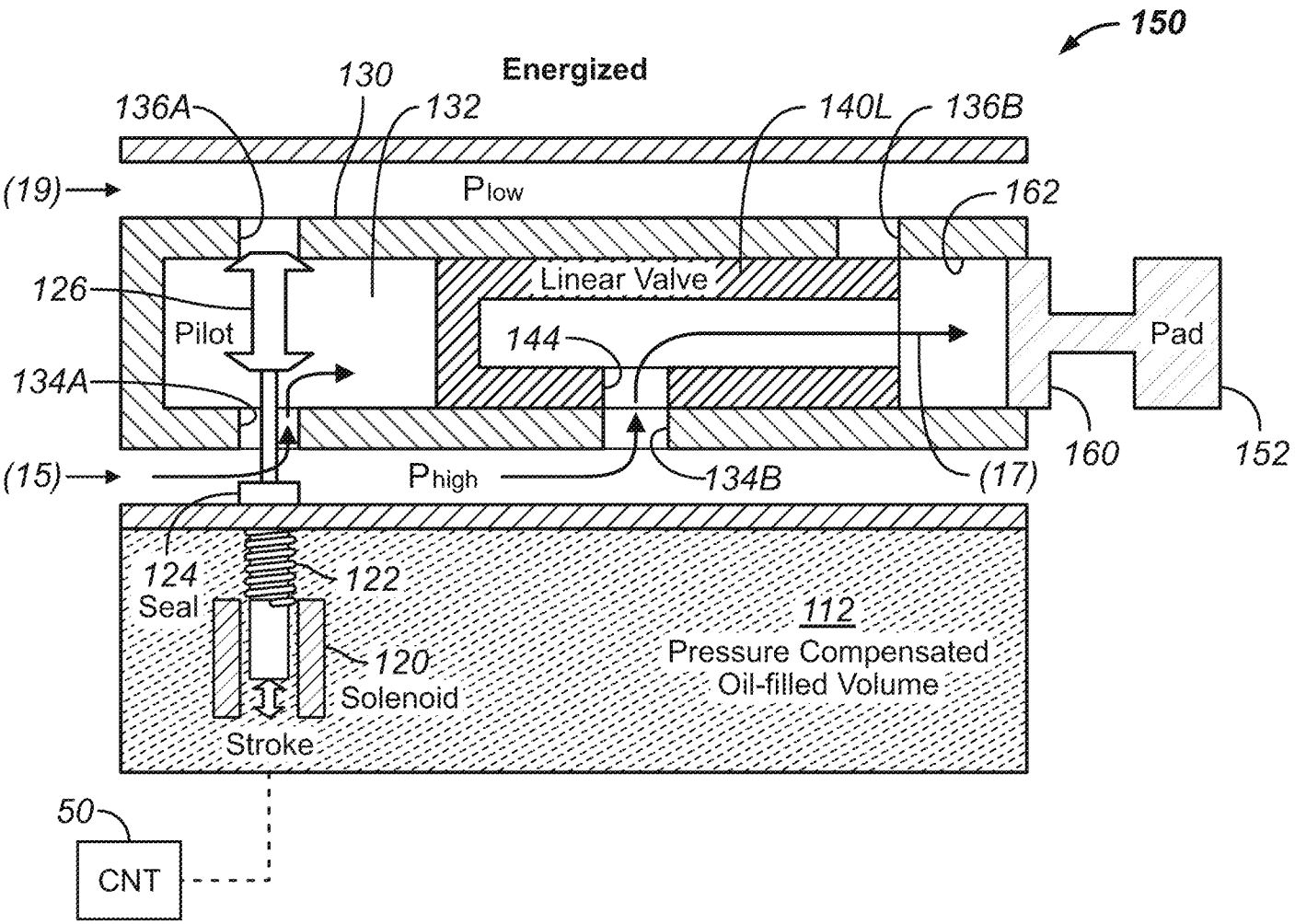
FIG. 4A schematically illustrates a first valve arrangement for an actuating device of the steering apparatus.
Figure 4B:
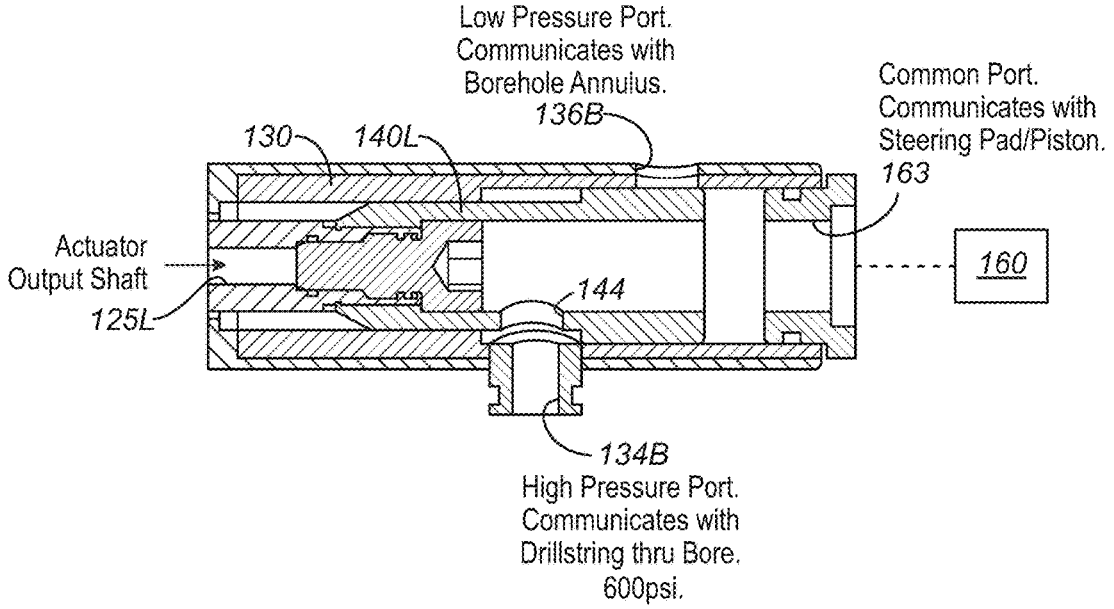
FIGS. 4B-4C illustrate cross-sectional views of a portion of the first valve arrangement of FIG. 4A.
Figure 4C:
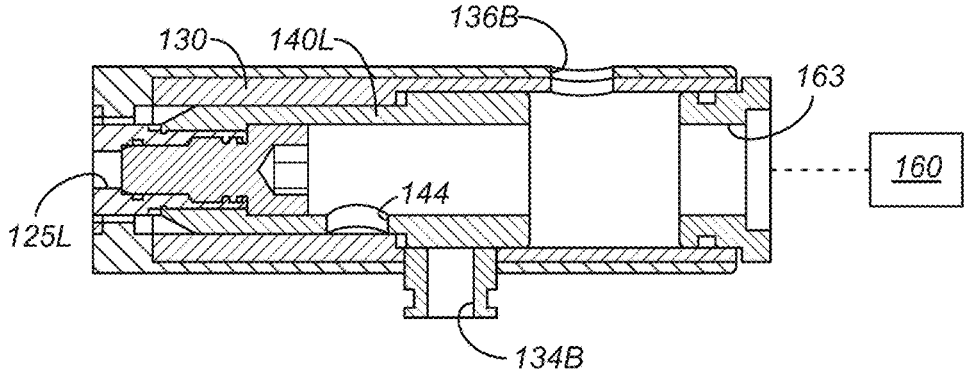
Figure 5A:
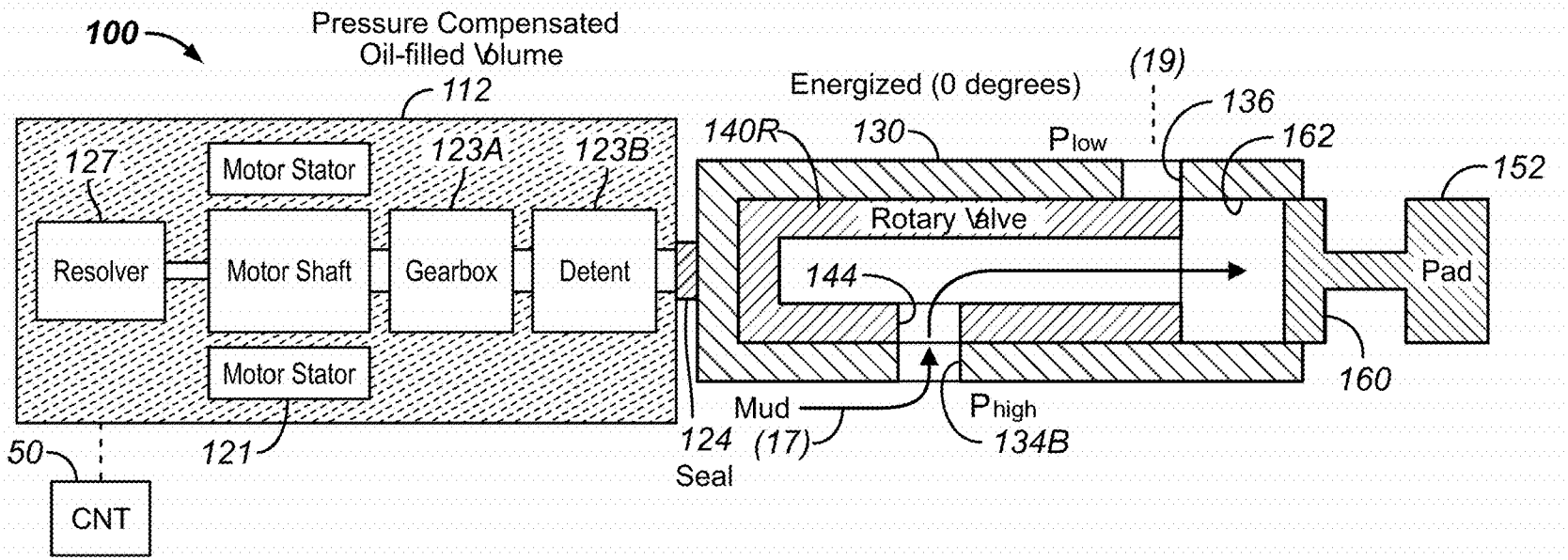
FIG. 5A schematically illustrates a second valve arrangement for an actuating device of the steering apparatus.
Figure 5B:
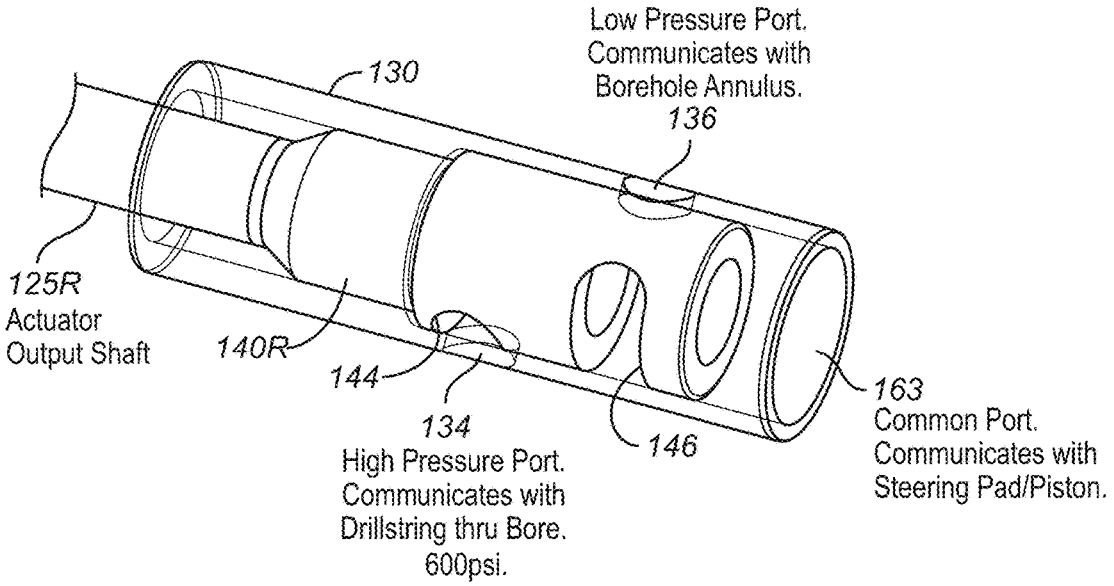
FIGS. 5B-5C illustrate perspective views of a portion of the second valve arrangement of FIG. 5A.
Figure 5C:
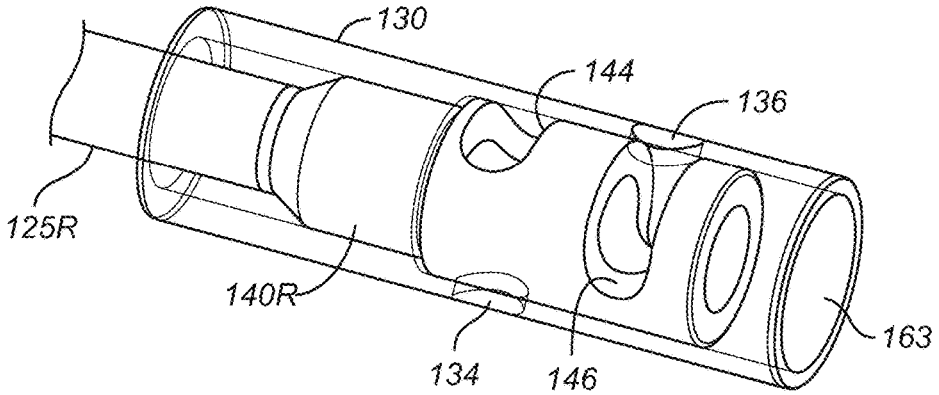

As noted above, internal flow components can direct at least a portion of the tool flow from the bore 108 independently to each of the piston chambers 162 for the pistons 160 and can vent the fluid in the piston chambers 162 independently to outside the apparatus 50 (i.e., to the borehole annulus). FIGS. 4A-4C illustration one arrangement of such internal flow components, while FIGS. 5A-5C illustrate another arrangement.

Turning to FIGS. 4A-4C, the actuator device 110 and directors 150 has a linear valve 140L for operation. As shown in FIG. 4A, the liner valve 140L is linearly moveable in a valve housing 130 between first and second conditions. The valve housing 130 is in fluid communication between high pressure $P_{high}$ communicating with the tool flow 15 (e.g., from the housing's bore) and low pressure $P_{low}$ communicating with vent flow 19 (e.g., to the borehore outside the housing). In particular, the housing 130 has inlets 134A-B exposed to the tool flow 15 and capable of communicating on both sides of the linear valve 140L. Likewise, the housing 130 has outlets 136A-B exposed to the vent flow 19 (e.g., the annulus) and capable of communicating on both sides of the linear valve 140L. One end of the housing 130 forms or communicates with a chamber 162 for a piston 160 used to actuate a pad 152 of the actuating director 150.

Differential pressure moves the linear valve 140L relative to the main inlet 134B and main outlet 136B to control fluid communication with respect to the piston's chamber 162. The differential pressure is controlled by a solenoid 120 that operates a pilot valve relative to pilot inlet and outlet 134A, 136A in the housing 130 on the other side of the linear valve 140L. The solenoid 120 is housed in a pressure-compensated oil-filled volume 112, has its stroke biased by a spring 122, and is controlled by the controller (50). The stroke of the solenoid 120 passes through a seal 124 to move the pilot valve 126 relative to the pilot inlet and outlet 134A, 136A to control fluid communication in the pressure chamber 132 behind the linear valve 140L.

In an energized condition as shown in FIG. 4A, the pilot valve 126 is operated to open the high pressure pilot inlet 134A to deliver fluid so that the high pressure fluid acts against the linear valve 140L in the housing 130. The valve 140L moves in the housing 130 to open fluid communication through the main inlet 134B for application to the piston 160 of the pad 152. The valve 140L so moved also closes the main outlet 136B so that the high pressure fluid is applied to the pad's piston 160. As a result, the pad 152 extends away from the housing 130 for engaging against the side of the borehole and altering the trajectory of the steering apparatus.

In an unenergized condition, the pilot valve 126 is operated to close the high pressure pilot inlet 134A and to open the low pressure pilot outlet 136A to vent fluid from the pressure chamber 132. The venting permits the linear valve 140L to shift back, closing the main inlet 134B and opening the main outlet 136B. Pressure in the piston chamber 162 can then be vented, and the piston 160 and pad 152 can be retracted and may be assisted by a biasing element as noted herein.

As an example, FIGS. 4B-4C show an embodiment of the linear valve 140L in the energized and unenergized condition. As shown energized in FIG. 4B, an actuator output shaft 125L has shifted the linear valve 140L in the housing 130 so that a side port 144 in the valve 140L communicates with the housing's main inlet 134B. The shifted linear valve 140L closes off the main outlet 136B. The chamber defined by the shifted linear valve 140L in the housing 130 communicates with the common port 163, which communicates with the steering pad/piston as noted above.

As shown de-energized in FIG. 4C venting fluid, the actuator output shaft 125L has shifted the linear valve 140L in the housing 130 so that the side port 144 in the valve 140L does not communicate with the housing's high pressure main inlet 134B. The shifted linear valve 140L, however, opens the housing's low pressure outlet 1366 to the housing 130. In this way, pressure remaining in the housing 130 and returned from the piston 160 at the common port 163 can be exhausted out of the main outlet 136B.

Turning now to FIGS. 5A-5C, the actuator device 110 and directors 150 has a rotary valve 140R for operation. As shown in FIG. 5A, the rotary valve 140R is rotatably moveable in a valve housing 130 between first and second conditions. The valve housing 130 is in fluid communication between high pressure $P_{high}$ communicating with the tool flow 15 (e.g., from the housing's bore) and low pressure $P_{low}$ communicating with vent flow 19 (e.g., to the borehore outside the housing). In particular, the housing 130 has an inlet 134 exposed to the tool flow 15 and has an outlet 136 exposed to the vent flow 19. One end of the housing 130 forms or communicates with a chamber 162 for a piston 160 used to actuate a pad 152 of the actuating director 150.

Rotation moves the rotary valve 140R relative to the inlet 134 and outlet 136 to control fluid communication with respect to the piston's chamber 162. The rotation is controlled by a motor 121 that turns the valve 140R to position ports 144 and 146 in the valve 140R relative to the inlet and outlet 134, 136 in the housing 130. The motor 121 is housed in a pressure-compensated oil-filled volume 112, has its turn controlled by the controller (50). The rotation of the motor 121 may be further controlled and monitored by a resolver 127, gear box 123A, and detent 123B and passes through a seal 124 to rotate the valve 140R.

In one configuration, the motor 121 is a brushless motor for a direct rotary drive. Position of the motor 121 can be determined for control purposes using the resolver 127 or the like. However, various forms of sensing could be used. For example, a Hall Effect sensor associated with the motor 121 can monitor the shaft's position to determine a given start position or the like. Moreover, pressure spikes from the open/closing of the valve can be used as a datum to figure out a given start position of the motor 121.

In a first (energized) condition as shown in FIG. 5A, the motor 121 is operated to rotate the rotary valve 140R open to deliver fluid so that a side port 144 of the valve 140R aligns with the inlet 134 for high pressure fluid. The valve 140R rotated in this state in the housing 130 also closes the outlet 136 for the housing 130 so that the high pressure fluid is applied to the pad's piston 160. As a result, the pad 152 extends for engaging against the side of the borehole and altering the trajectory of the steering apparatus.

In a second (de-energized) condition, the motor 121 is operated to close the inlet 134 and to open the low outlet 136 to vent fluid from the chamber 162. In particular, the rotary valve 140R covers the inlet 134 by moving the port 144 out of alignment and uncovers the outlet 136 by moving another port (146) into alignment. Pressure in the piston chamber 162 can then be vented, and the piston 160 and pad 152 can be retracted and may be assisted by a biasing element as noted herein.

As an example, FIGS. 5B-5C show an embodiment of the rotary valve 140R in the energized and unenergized conditions. As shown energized in FIG. 5B, an actuator output shaft 125R (i.e., from the motor 121) has rotated the rotary valve 140R in the housing 130 so that the side port 144 in the valve 140R communicates with the housing's inlet 134. The rotated valve 140R closes off the housing's outlet 136. The chamber defined by the rotated valve 140R in the housing 130 communicates with a common port 163, which communicates fluid with the steering pad/piston.

As shown de-energized in FIG. 5C venting fluid, the actuator output shaft 125R has rotated the rotary valve 140R in the housing so that the side port 144 in the valve 140R does not communicate with the housing's inlet 134. The rotated valve 140R, however, opens the housing's low outlet 136 to the chamber by aligning the valve's port 146 with the outlet 136. In this way, pressure remaining in the chamber and returned from the piston at the common port 163 can be exhausted out of the outlet 136. As can be seen, the ports 144 and 146 in the valve 140 can be arcuate slots defined around the rotary valve 140R to align or misalign at various orientations relative to the inlet and outlet 134 and 136.

Figure 6:
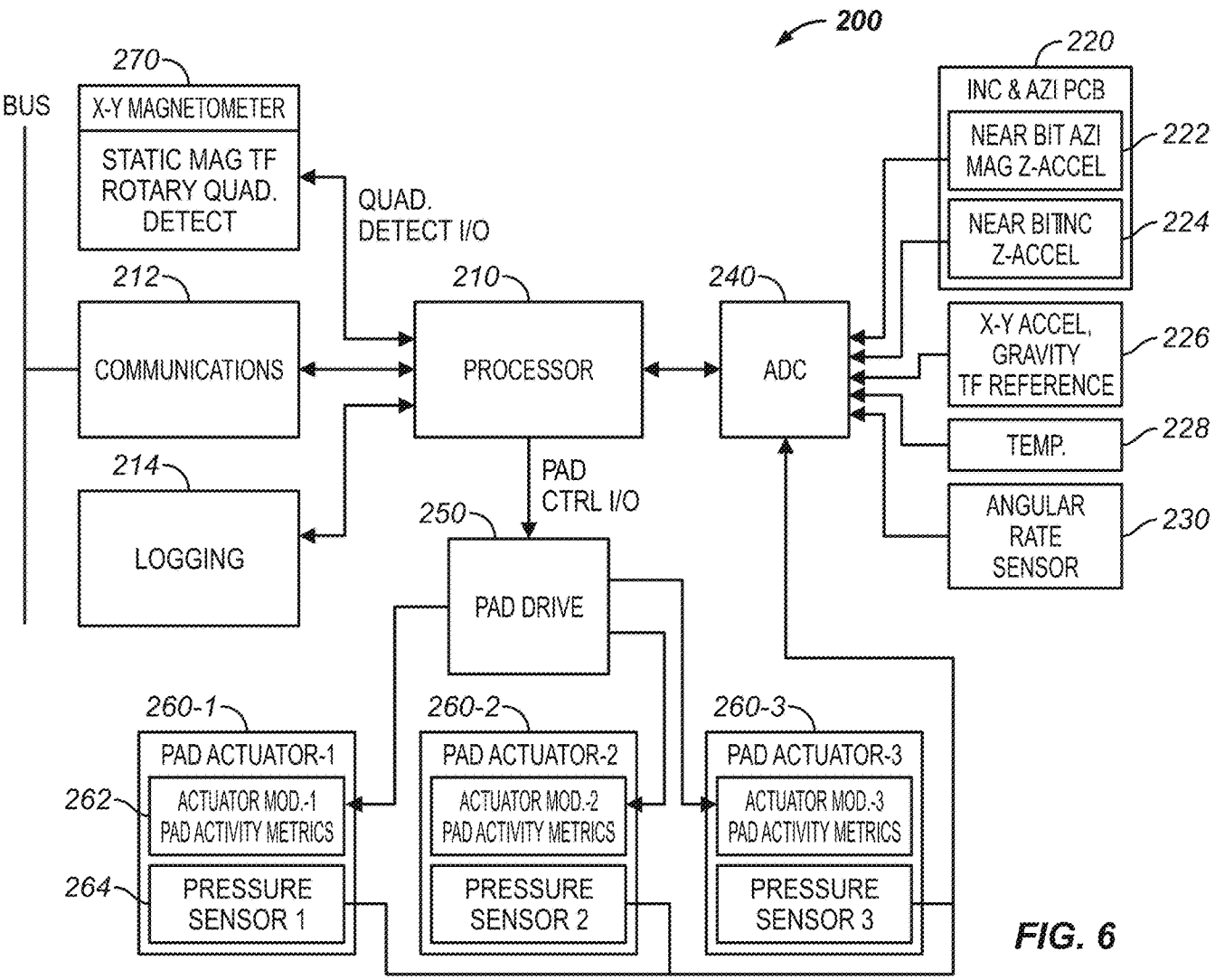
FIG. 6 illustrates a schematic of a control system for the disclosed steering apparatus.

FIG. 6 illustrates a schematic of a control system 200 for the steering apparatus 50 of the present disclosure. (Further details are disclosed in incorporated U.S. application Ser. No. 15/282,379, entitled "Control for Rotary Steerable System".) The control system 200 as depicted here can combine or can be part of one or more previously disclosed elements, such as the control assembly 30, controller 60, etc., which are consolidated in the description here. Separate reference to some of the components may have been made for the sake of simplicity.

The control system 200 includes a processing unit 210 having processor(s), memory, etc. Sensor elements 220 to 230 interface with the processing unit 210 and may use one or more analog-to-digital converters 240 to do so. In general, the control system uses an angular rate gyroscope to determine an angular rate of the apparatus 50, and readings from a magnetometer give a highside of the apparatus 50 for orientation of the apparatus 50 relative to the borehole.

For example, various sensor elements can include inclinometers, magnetometers, accelerometers, and other sensors that provide position information to the processing unit 210. In particular, an inclinometer and azimuthal sensor element 220 can include a near-bit azimuthal sensor 220 and a near-bit inclinometer sensor 224, which may use magnetometers and Z- axis accelerometers. Toolface can be provide for the apparatus (50) and can have X and Y axes accelerometers and a gravity toolface reference 226. A temperature sensor 228 can provide temperature readings. Finally, an angular rate sensor 230 can be an angular rate gyroscope (ARG) and provide the angular rate of the apparatus (50) during operation for obtaining position readings.

The processing unit 210 also communicates with an X-Y magnetometer element 270, which provides static magnetic toolface and detects the rotary quadrant of the apparatus (50) during operation. The processing unit 210 can communicate with other components of the apparatus (50) via communication circuitry 212 and a bus and can store information in logging memory 214.

Finally, the processing unit 210 provides controls to a pad drive 250 used for the multiple pad actuators 260-1, 260-2, 260-3 for the actuator devices of the apparatus (50). Each of the pad actuators 260 includes a module 262 for operating the actuator 262. A pressure sensor or transducer 264 can also be used for monitoring operation of the pad actuator 260 and can provide feedback of pressure readings to the processing unit 210. The module 262 can monitor pad activity metrics in addition to the pressure sensor monitoring of the pressure of the piston actuating the pad. The pilot-actuated valves may use pressure sensors to determine the pads' operation in the first instance. The pressure sensors can provide pressure readings that can also help determine pad wear and to verify overall operation.

The control system 200 operates based on discrete position information obtained with the various sensor elements 222, 224, 226, 230, 270, etc. For example, the resolution of the position information can be 0.5 ms @ 300 rpm, which would give an angular resolution of about 0.9° for the apparatus' rotation. Additionally, the angular rate gyroscope sensor 230 is used in conjunction with X-Y crossovers from the X-Y magnetometer element 270 to obtain position information at about 3-kHz. The X-Y accelerometers obtain an offset value of static gravity to magnetic highside for determining toolface of the apparatus (50).

The processing unit 210 processes the input of the various readings and the monitoring of the actuators and provide actuator control signals to the pad drive 250, which in the present embodiment includes three channels for the three actuator modules 260-1, 260-2, and 260-3.

The multiple, independently operable actuators 260 afford some redundancy. In this way, the control system 200 can operate the apparatus although one or even two of the actuators 260 have failed while still maintaining some directional control. An integral fail safe mechanism can be used to ensure the valves of the actuators 260 fail in a closed position, or the control system 200 can receive feedback to detect the telltale signs of failure and preemptively park the actuator 260 in a closed position. The pressure sensors 264 and the activity metrics 262 can be used for such purposes.

Figure 7B:
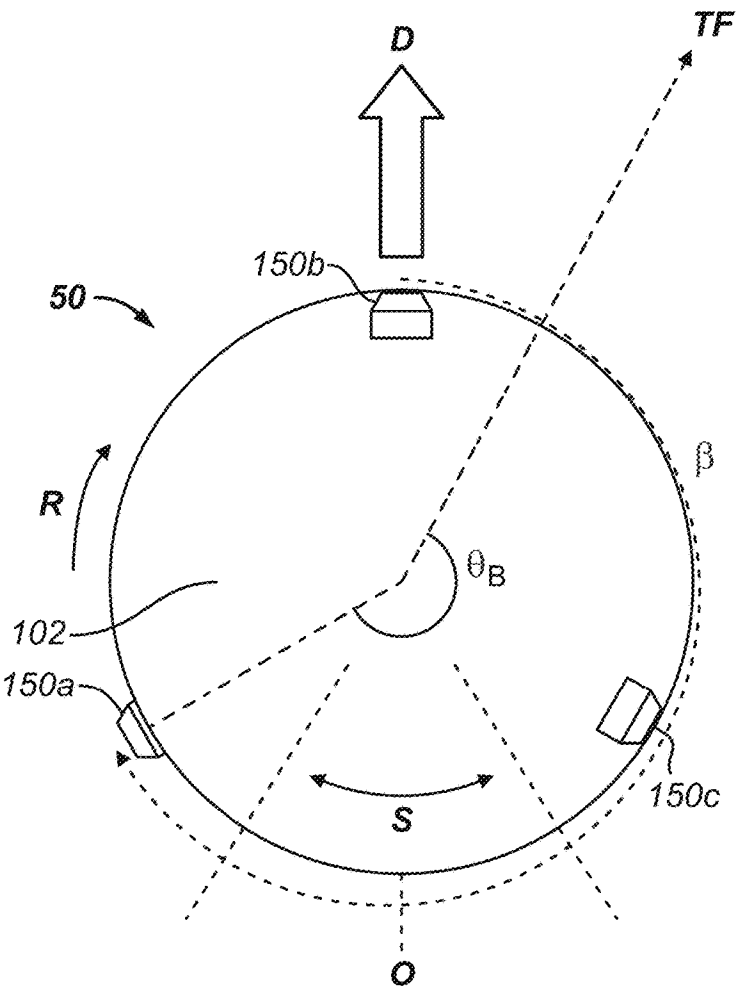
FIGS. 7A-7B schematically illustrate end views of the steering apparatus during operation.
Figure 7A:
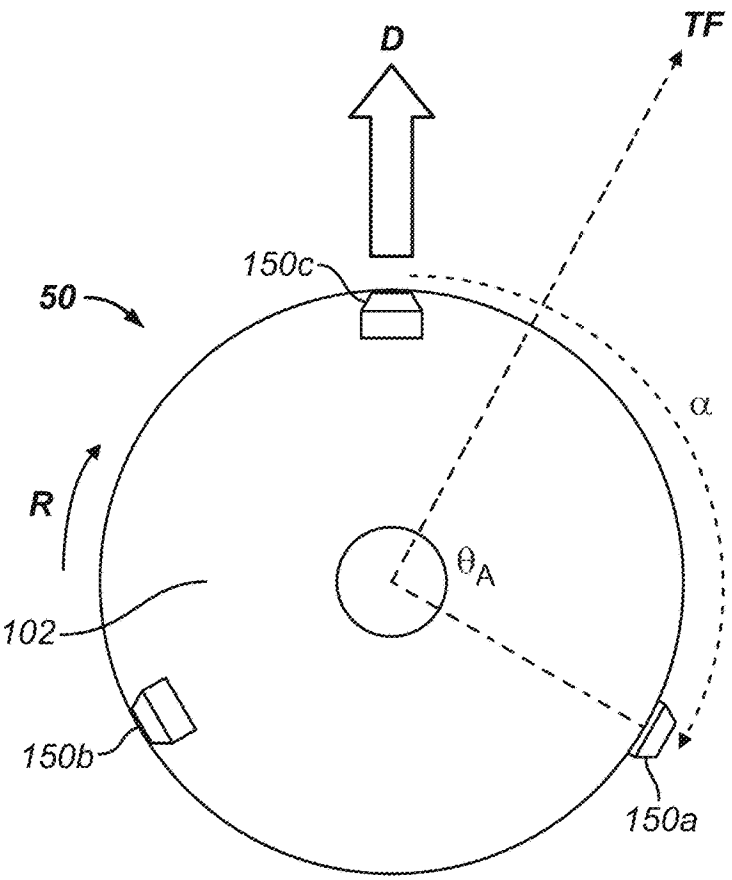

Having an understanding of the steering apparatus 50 and the control system 200, discussion now turns to operation of the drilling assembly 20. FIGS. 7A-7B illustrate schematic end views of the steering apparatus 50 in two states of operation. As noted herein, the steering apparatus 100 has multiple directional devices or directors disposed around the housing 102, such as the three directors 150*a-c* depicted here.

As expressed herein, the directors 150*a-c* rotate with the housing 102, and the housing 102 rotates with the drillstring (22). As the drill bit (40) rotates with the housing 102 and the drillstring (22), the transverse displacement of the directors 150*a-c* can then displace the longitudinal axis of the housing 102 relative to the advancing borehole. This, in turn, tends to change the trajectory of the advancing borehole. To do this, the independent extensions/retractions of the directors 150*a-c* are timed relative to a desired direction D to deviate the apparatus 50 during drilling. In this way, the apparatus 50 operates to push the bit (40) to change the drilling trajectory.

FIGS. 7A-7B show one of the movable directors 150*a* extended therefrom during a first rotary orientation (FIG. 7A) and then during a later rotary orientation (FIG. 7B) after the housing 102 has rotated. Because the steering apparatus 50 is rotated along with the drillstring (22) and/or with a mud motor (not shown) disposed above the apparatus 50, the operation of the steering apparatus 50 is cyclical to substantially match the period of rotation of the drillstring (22) and/or mud motor.

As the steering apparatus 50 rotates, the orientation of the directors 150*a-c* is determined by the control system (200), position sensors, toolface (TF), etc. When it is desired to deviate the drill bit (40) in a direction towards the direction given by arrow D, then it is necessary to extend one or more of the directors 150*a-c* as they face the opposite direction O. The control system (200) calculates the orientation of the diametrically opposed position O and instructs the actuators for the directors 150*a-c* to operate accordingly. Specifically, the control system (200) may produce the actuation so that one director 150*a* extends at a first angular orientation ($\alpha$in FIG. 7A) relative to the desired direction D and then retracts at a second angular orientation ($\beta$in FIG. 7B) in the rotation R of the steering apparatus 50.

Because the director 150*a* is rotating in direction R with the housing 102, orientation of the director 150*a* relative to a reference point is determined using the toolface (TF) of the housing 102. This thereby corresponds to the director 150*a* being actuated to extend starting at a first angular orientation θA relative to the toolface (TF) and to retract at a second angular orientation θA relative to the toolface (TF). As will be appreciated, the toolface (TF) of the housing 102 can be determined by the control system (200) using the sensors and techniques discussed previously.

Because the director 150*a* does not move instantaneously to its extended condition, it may be necessary that the active deflection functions before the director 150*a* reaches the opposite position O and that the active deflection remains active for a proportion of each rotation R. Thus, the director 150*a* can be extended during a segment S of the rotation R best suited for the director 150*a* to extend and retract relative to the housing 102 and engage the borehole to deflect the housing 102. The RPM of the housing's rotation R, the drilling direction D relative to the toolface (TF), the operating metrics of the director 150*a*, and other factors involved can be used to define the segment S. If desired, it can be arranged that the angles α and β are equally-spaced to either side of the position O, but because it is likely that the director 150*a* will extend gradually (and in particular more slowly than it will retract) it may be preferable that the angle β is closer to the position O than is the angle α.

Of course, the steering apparatus 50 as disclosed herein has the additional directors 150*b-c* arranged at different angular orientations about the housing's circumference. Extension and retraction of these additional directors 150*b-c* can be comparably controlled in conjunction with what has been discussed with reference to FIGS. 7A-7B so that the control system (200) can coordinate multiple retractions and extensions of the several directors 150*a-c* during each of (or one or more of) the rotations R. Thus, the displacement of the housing 102 and directors 150*a-c* can be timed with the rotation R of the drillstring (22) and the apparatus 50 based on the orientation of the steering apparatus 50 in the advancing borehole. The displacement can ultimately be timed to direct the drill bit (40) in a desired drilling direction D and can be performed with each rotation or any subset of the rotations.

Drilling straight ahead can be achieved along with proportional control. Drilling straight ahead can involve varying the target direction D over each rotation or can involve switching the system off (i.e., having each of the directors 150*a-c* retracted). Proportional control can be achieved by pushing 1, 2 or 3 times per rotation or by varying the arc over which each director 150*a-c* is extended. Moreover, the disclosed system can have all directors 150*a-c* retracted OR all extended at the same time. Retraction of all devices 150*a-c* can be used in advancing the borehole along a straight trajectory at least for a time. Extension of all of the devices 150*a-c* can provide reaming or stabilizing benefits during drilling.

So far, the disclosed system has been directed to a push-the-bit configuration of steering. In push-the-bit, the drilling direction of the bit in a desired direction is changed by pushing against the side of the borehole in an opposing direction. Comparable components and techniques disclosed herein can instead be use in the other type of steering configuration of point-the-bit.

As a brief example, the disclosed system can use a fulcrum stabilizer to convert the push-the-bit configuration into a point-the-bit configuration. The fulcrum stabilizer can provide a fulcrum point between the deflectors and the drill bit so that pushing the deflectors against the side of the wellbore in the same direction as the intended bit direction can push the bit for direction drilling.

Figure 8A:
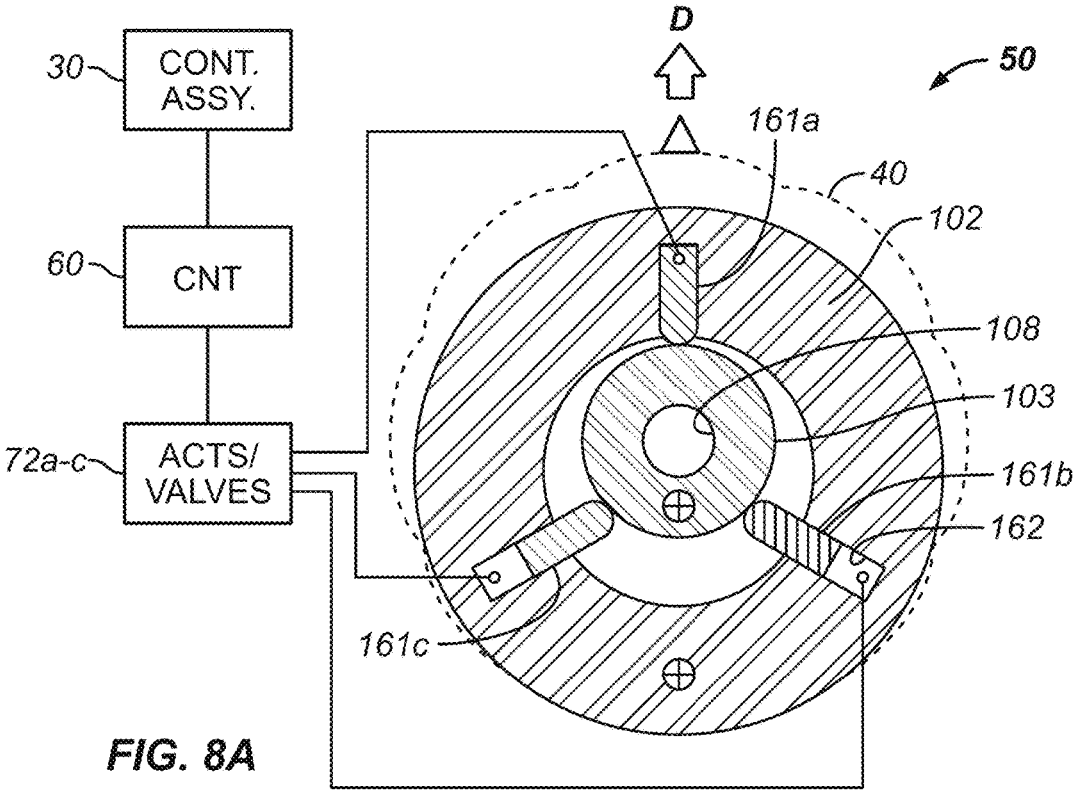
FIGS. 8A-8B schematically illustrate the disclosed system having a point-the-bit steering configuration.
Figure 8B:
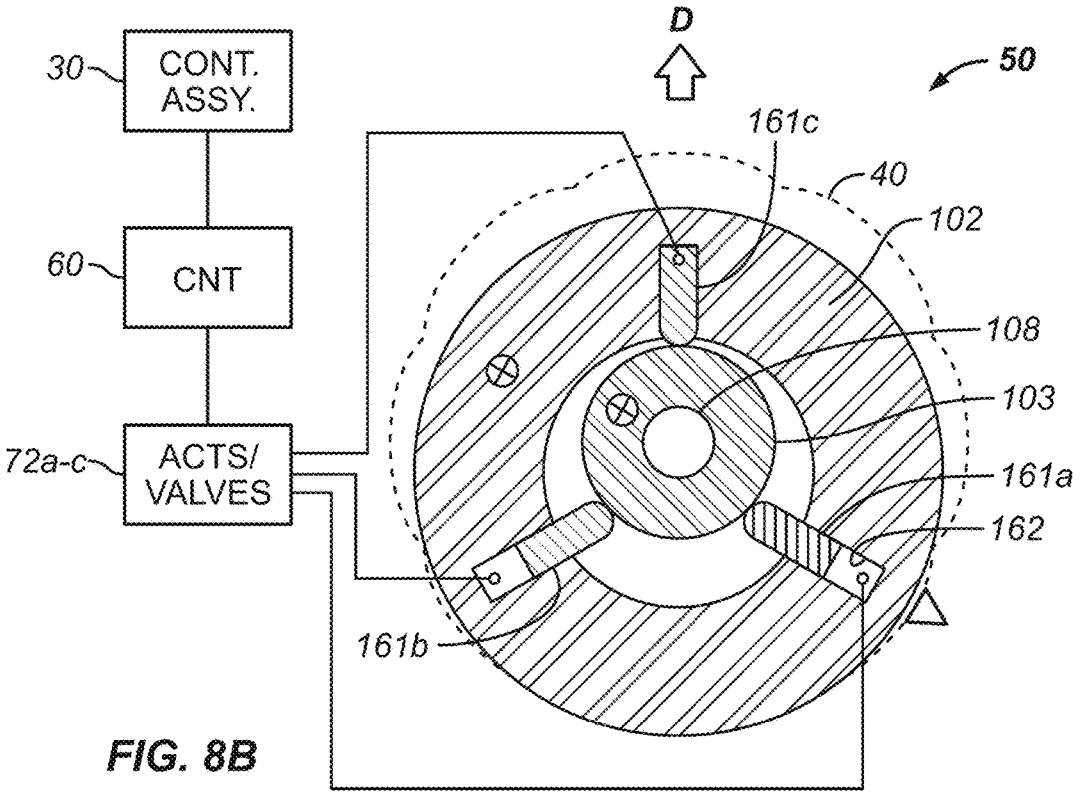

In another brief example, FIGS. 8A-8B schematically illustrate the disclosed system 50 having a point-the-bit steering configuration. In this point-the-bit configuration, the drilling direction of the bit 40 in a desired direction is changed by pushing an internal shaft 103 of the system 50 having the drill bit 40 in the desired direction. As such, the components and techniques disclosed herein with respect to the push-the-bit system (e.g., actuators, valves, pistons, etc.) can apply equally well to a point-the-bit system. In fact, as shown in FIGS. 8A-8B, the system 50 involves a reversal of the pushing components from an external (push) to an internal (point) arrangement and involves a reversal of the directing of pushing from external to internal.

In particular, FIGS. 8A-8B show a number of pistons 161*a-c* disposed in piston chambers 162 of the system's housing 102. The internal shaft 103 connected to the drill bit 40 is positioned in the housing 102, and the various pistons 161*a-c* are movable against the shaft 103 to change the pointing of the bit 40. The internal shaft 103 can be a jointed shaft, a flexible shaft, or the like having the drill bit 40 connected to it so that pushing against the shaft 103 in one direction can either move the drill bit 40 in the same direction or an opposite direction. As noted herein, the entire system 50 rotates, meaning that the housing 102, pistons 161*a-c*, shaft 103, etc. all rotate in the borehole. The control assembly 30, controller 60, actuator-valves 72a-c, and the like actuate the various pistons 161*a-c* to point the shaft 103 and connected bit 40 in a desired direction in the borehole in a manner similar to the functioning discussed in previous configurations.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the disclosed subject matter. Therefore, it is intended that the disclosed subject matter include all modifications and alterations to the full extent that they come within the scope of the disclosed embodiments or the equivalents thereof.

What is claimed is:

1. A drilling assembly disposed on a drillstring for deviating a borehole advanced by a drill bit, the assembly comprising:

a housing disposed on the drillstring and transferring rotation to the drill bit, the housing having a bore communicating fluid from the drillstring to the drill bit;

a plurality of directors disposed on the housing to rotate therewith, each of the directors being independently movable between an extended condition and a retracted condition relative to the housing; and a plurality of actuators disposed on the housing, each of the actuators having an associated one of a plurality of valves in fluid communication with the bore, each of the directors having an associated one of the actuators, each of the associated valves comprising a valve member rotatable relative to an inlet port and an outlet port, each of the actuators independently operable to rotate the associated valve member between first and second conditions, each of the valve members in the first condition directing communicated fluid at the inlet port from the bore to the associated director and extending the associated director toward the extended condition, each of the valve members in the second condition venting the communicated fluid from the associated director to the outlet port and at least permitting the associated director to retract toward the retracted condition.

2. The assembly of claim 1, wherein the housing has the rotation imparted thereto by the drillstring, by a motor disposed on the drillstring, or by both the drillstring and the motor.

3. The assembly of claim 1, further comprising a controller independently operating each of the actuators.

4. The assembly of claim 3, wherein the controller is operable to operate each of the actuators independently of one another.

5. The assembly of claim 3, wherein the controller is operable to operate at least two of the actuators with a same operation at a same time as one another.

6. The assembly of claim 3, wherein the controller is disposed to rotate with the housing, the controller determining angular orientations of each of the directors relative to a desired trajectory for the borehole and translating the determined orientations to the independent actuations of each of the actuators to deviate the borehole toward the desired trajectory.

7. The assembly of claim 3, wherein the controller comprises:

an angular rate gyroscope measuring an angular rate of the housing as the housing rotates;

a magnetometer measuring orientation of the housing as the housing rotates relative to the borehole;

an accelerometer measuring a gravity reference; and control circuitry taking a desired trajectory for the borehole and translating the desired trajectory into independent actuations of the one or more actuators based on the angular rate, the gravity reference, the orientation of the housing.

8. The assembly of claim 1, wherein the communicated fluid is continuously vented from the directors; wherein each of the valve members in the second condition actively vents the communicated fluid from the associated director; or wherein each of the valve members in the first and second conditions passively vents the communicated fluid from the associated director.

9. The assembly of claim 1, wherein each actuator is independently operable to rotate the associated valve member in any of a plurality of variable positions between the first and second conditions, each of the variable positions at least proportionally directing the communicated fluid from the bore to the associated director.

10. The assembly of claim 9, wherein each of the valve members in any of the variable positions at least permits venting of the communicated fluid from the associated director.

11. The assembly of claim 1, wherein each of the actuators comprises a drive operable to rotate the valve member.

12. The assembly of claim 11, wherein the drive comprises a motor coupled to the valve member.

13. The assembly of claim 1, wherein the valve member in the first condition opens the inlet port and closes the outlet port, the inlet port communicating the communicated fluid from the bore.

14. The assembly of claim 13, wherein the valve member in the second condition closes the inlet port and opens the outlet port, the outlet port communicating the communicated fluid from the director to the borehole.

15. The assembly of claim 1, wherein the each of the directors comprises a piston disposed in a piston chamber of the housing and being movable via fluid communication of the piston chamber with the associated actuator.

16. The assembly of claim 15, wherein each of the directors comprises a biasing member disposed in the housing and biasing the director toward the retracted condition against the piston.

17. The assembly of claim 1, wherein each valve comprises a stationary element disposed in communication with the inlet port, the outlet port, and the associated director; and wherein each valve member comprises a rotatable element being rotatable relative to the stationary element and disposed in communication with the associated director, the rotatable element in the first condition at least placing the inlet port in communication with the associated director, the rotatable element in the second condition at least placing the outlet port in communication with the associated director.

18. The assembly of claim 17, wherein the rotatable element comprises an inner cylinder having first and second ports and be rotatably disposed in an outer cylinder of the stationary element, ends of the inner and outer cylinders disposed in communication with the associated director, the rotatable element in the first condition at least communicating the first port with the inlet port, the rotatable element in the second condition at least communicating the second port with the outlet port.

19. A drilling assembly disposed on a drillstring for deviating a borehole advanced by a drill bit, the assembly comprising:

a housing disposed on the drillstring and transferring rotation to the drill bit, the housing having a bore communicating fluid from the drillstring to the drill bit;

a plurality of directors disposed on the housing to rotate therewith, each of the directors being independently movable between an extended condition and a retracted condition relative to the housing; and a plurality of actuators disposed on the housing, each of the actuators having an associated one of a plurality of valves in fluid communication with the bore, each of the directors having an associated one of the actuators, wherein the associated valve of each of the actuators comprises a valve member movable linearly via a differential pressure relative to an inlet port and an outlet port, each of the actuators independently operable to move the associated valve member between first and second conditions, each of the valve members in the first condition directing communicated fluid at the inlet from the bore to the associated direction and extending the associated director toward the extended condition, each of the valve members in the second condition venting the communicated fluid from the associated director to the outlet and at least permitting the associated director to retract toward the retracted condition; and wherein each of the actuators comprises a pilot operable between a direct condition and a vent condition, the pilot in the direct condition directing the communicated fluid from the bore to a first side of the valve member, the pilot in the vent condition venting the communicated fluid from the first side of the valve member to low pressure.

20. The assembly of claim 19, wherein the pilot in the vent condition vents the communicated fluid from the first side of the valve member to the low pressure: (i) in the borehole, (ii) downstream of a choke in the bore of the assembly, or (iii) downstream of a restriction internal to the assembly.

21. The assembly of claim 19, wherein the pilot is operated with a solenoid.

22. The assembly of claim 19, wherein the valve member opens the inlet port and closes the outlet port when moved by the pilot in the direct condition, the inlet port communicating the communicated fluid from the bore to extend the director.

23. The assembly of claim 19, wherein the valve member closes the inlet port and opens the outlet port when moved by the pilot in the vent condition, the outlet port communicating the communicated fluid from the director to the borehole to retract the director.

24. The assembly of claim 19, wherein each valve comprises a stationary element in communication with the inlet port, the outlet port, and the associated director; and wherein each valve member comprises a movable element being linearly movable relative to the stationary element, the movable element in a first position at least placing the inlet port in communication with the associated director, the movable element in a second position at least placing the outlet port in communication with the associated director.

25. The assembly of claim 24, wherein the stationary element defines a first port in communication with the communicated fluid and defines a second port in communication with the low pressure; and wherein the pilot comprises a check element movable in the stationary element between first and second conditions relative to the first and second ports on the first side of the movable element, the check element in the first condition opening the first side of the moveable element in communication with the communicated fluid and closing the first side of the moveable element from communication with the low pressure, the check element in the second condition opening the first side of the moveable element in communication with the low pressure and closing the first side of the moveable element from communication with the communicated fluid.

26. A drilling method, comprising:

advancing a borehole with a drill bit on a drilling assembly coupled to a drillstring by transferring rotation of the drilling assembly to the drill bit;

independently operating actuators disposed to rotate with the drilling assembly, each of the actuators associated with one of a plurality of directors, each of the actuators having an associated one of a plurality of valves in fluid communication with flow through the drilling assembly, each of the associated valves comprising a valve member rotatable relative to an inlet port and an outlet port;

controlling at least some of the flow through the drilling assembly using the independently operated actuators by rotating the valve member of each of one or more of the independently operable actuators between first and second conditions relative to the inlet port and the outlet port, directing the controlled flow at the inlet port to the associated director with the each valve member in the first condition to extend the associated director toward an extended condition, and venting the controlled flow from the associated director to the outlet port with the each valve member in the second condition to at least permit the associated director to retract toward a retracted condition;

independently moving the associated directors disposed to rotate with the drilling assembly between the extended and retracted conditions using the controlled flow; and deviating the advancing borehole with the drilling assembly using the independently moved directors.

27. The method of claim 26, wherein independently operating the actuators and controlling the flow comprises:

measuring an angular rate of the drilling assembly as the drilling assembly rotates;

measuring orientation of the drilling assembly as the drilling assembly rotates relative to the borehole;

taking a desired trajectory for the borehole; and translating the desired trajectory into independent actuations of the actuators based on the angular rate and the orientation of the drilling assembly.

28. The method of claim 26, wherein directing the controlled flow through the drilling assembly to the one or more of the associated directors by operating the one or more associated valves of the actuators comprises directing the controlled flow proportionally to the one or more of the associated directors by operating the one or more associated valves in proportional states to produce proportional force of the one or more of the associated directors.

29. The method of claim 26, wherein independently moving the associated directors disposed to rotate with the drilling assembly using the controlled flow comprises independently extending one or more of the associated directors per a given rotation.

30. The method of claim 26, wherein independently moving the associated directors disposed to rotate with the drilling assembly using the controlled flow comprises adjusting an open arc angle over which the associated directors are extended.

31. The method of claim 26, wherein independently moving the associated directors disposed to rotate with the drilling assembly using the controlled flow comprises modifying a force vector resulting from extension of the associated directors by adjusting a target direction over course of a given rotation.

32. The method of claim 26, wherein independently moving the associated directors disposed to rotate with the drilling assembly using the controlled flow comprises permitting retraction of the one or more associated directors in the retracted condition on the drilling assembly by at least in part venting of the controlled flow from the one or more associated directors.

33. The method of claim 26, wherein deviating the advancing borehole with the drilling assembly using the independently moved directors comprises pushing the drill bit with engagement of the independently moved directors against the advancing borehole.

34. The method of claim 26, further comprising:

monitoring operations of the actuators and/or the directors;

determining an indication of failure of a given one of the actuators and/or the directors based on the monitoring; and disabling the operation of the given one based on the indication.

35. The method of claim 34, wherein disabling the operation of the given one based on the indication comprising disabling the given one of the directors in the retracted condition by closing off flow to the given director.

* * * * *